US005787732A

United States Patent [19]

Perron et al.

[11] Patent Number: 5,787,732

[45] Date of Patent: Aug. 4, 1998

[54] KNITTED SUPPORT GARMENT AND METHOD FOR MAKING

[76] Inventors: Maurice Perron, 2 Bis rue Paul Cazin; Michel Bonnin, Les Chaumottes; Marie-Christine Aillet, 2 rue Bernard Renault, all of 71400 Autun, France

[21] Appl. No.: 781,693

[22] Filed: Jan. 10, 1997

[51] Int. Cl.[6] ..... D04B 1/24

[52] U.S. Cl. ..... 66/177; 2/401; 450/104; 450/107

[58] Field of Search ..... 66/182, 177, 178 R, 66/180; 2/401, 400, 406; 450/104, 107, 115, 122, 128, 131, 132, 99

[56] References Cited

U.S. PATENT DOCUMENTS

| | | | |
|---|---|---|---|
| 2,168,009 | 8/1939 | Van Praag | 2/27 |
| 2,953,134 | 9/1960 | Kauff | 128/548 |
| 3,301,261 | 1/1967 | Farino | 128/528 |
| 3,774,621 | 11/1973 | Dabe | 128/539 |
| 3,824,812 | 7/1974 | Matthews et al. | 66/177 |
| 3,946,579 | 3/1976 | Heinig | 66/177 |
| 4,663,946 | 5/1987 | Wright | 66/177 |
| 4,729,131 | 3/1988 | Thygesen | 66/177 |
| 5,590,548 | 1/1997 | Osborne | 66/177 |

*Primary Examiner*—Andy Falik

[57] ABSTRACT

A hosiery item such as tights formed from a pair of joined circularly by knitted tubes. In some areas such as the brief it has knitted regions having courses with curved angular ranges having stich heights. The front of the brief is characterized by high and medium compression stripes at least one of which cross over at its ends to form a ventral panel. same course outside these parts. See, for example, the area forming the briefs of the tights having at least one high compression strip, the ends of which cross over at the front and form a ventral panel.

5 Claims, 2 Drawing Sheets

KNITTED SUPPORT GARMENT AND METHOD FOR MAKING

BACKGROUND OF THE INVENTION

1. Field of the Invention

The present invention is a method of knitting tubular items, such as tights for example, on a hosiery knitting machine.

2. Description of the Related Art Including Information Disclosed under 37 CFR § 1.97–1.99.

The invention is also directed to hosiery items and in particular to tights manufactured by the method.

A conventional way to make tights is to sew together two tubular knit cylinders that have been slit in the upper part and sewn together along the slit edges to form the brief of the tights. This part of the garment is usually knitted to be more elastic and stronger than the stockings.

To obtain tights of better quality it is possible to "reduce" and to "increase" areas in the briefs to provide a better fit to conform to the shape of the body. These methods, however, make manufacturing slower and more complicated.

A separate gusset may be attached to the area between the legs of the cylinders to give sufficient fullness to the formed brief, so that the item is more comfortable to wear.

With a view to improving on the conventional method, Applicants have previously proposed in document FR-A-2 231 226 a method in which, in order to obtain differences in height and/or elasticity in the lengthwise direction of the knit cylinders and in certain parts corresponding to given angular ranges of the stripes, the cylinders are knit in these ranges with stitches having varying stitch heights. This is obtained by knitting only part of the stitches and by knitting the threads in the courses that are not knitted in the aforementioned angular regions. The height of the stitches in the same course is not modified.

If this method is applied, for example, to the upper part of two tubular cylinders that are slit and joined together in their upper parts to form a brief for a pair of tights, there is automatically obtained an upper part of the tights shaped to form a brief that fit the shape of the corresponding part of the body.

To satisfy the aesthetic demands of wearers of tights, ways have been sought to create a greater restraining effect in the stomach region than elsewhere. The method mentioned above can contribute to this to some degree. However, to achieve better ventral reinforcement, it has been proposed to manufacture tights incorporating briefs or other tubular hosiery items by heat bonding reinforcements to a main knitted part (cf document EP-A-0 255 101). This obviously complicates the manufacturing process.

SUMMARY OF THE INVENTION

It is therefore an objective of the invention to provide a new method of knitting tubular items, and items obtained in this way, that do not have the aforementioned drawbacks. To be more precise, the aim of the invention is, by means of a simple knitting process, to manufacture an item having an enhanced restraining effect and/or reduced stretchiness in selected regions.

The invention achieves this objective by means of a knitting process of the general type disclosed in document FR-A-2 231 226 but in which, in selected regions, the stitches are knitted with their heights modified in the same course, whereas the cited document proposed that the stitch height should be modified, if at all, only from one course to another.

Surprisingly, this method provides a simple way of obtaining a much better restraining effect in a selected region, for example, in the front region of the brief of the tights, apparently flattening the stomach of the wearer.

The invention also concerns a hosiery item formed from tubular parts made by the above knitting method and characterized in that in some parts and for given angular ranges it includes regions curved having stitches with stitch heights measured in the lengthwise direction of the tube smaller than the stitch heights in the same course outside these parts.

The hosiery item may constitute a pair of tights formed by joining two tubularly knit cylinders and a brief at the top. The parts with reduced stitch heights are provided in the part forming the briefs of the tights, for example, in the form of at least one high compression stripe the ends of which cross over at the front and form a ventral panel.

A medium compression second strip is advantageously provided under the first strip.

Other features and advantages of the invention will emerge from the following description of one embodiment. Reference is made to the appended drawings, in which:

BRIEF DESCRIPTION OF THE DRAWINGS

Referring now to the drawings, FIGS. 1 and 2 show knitted tights 1 defining a plurality of regions, namely from top to bottom, including:

Figure 1:
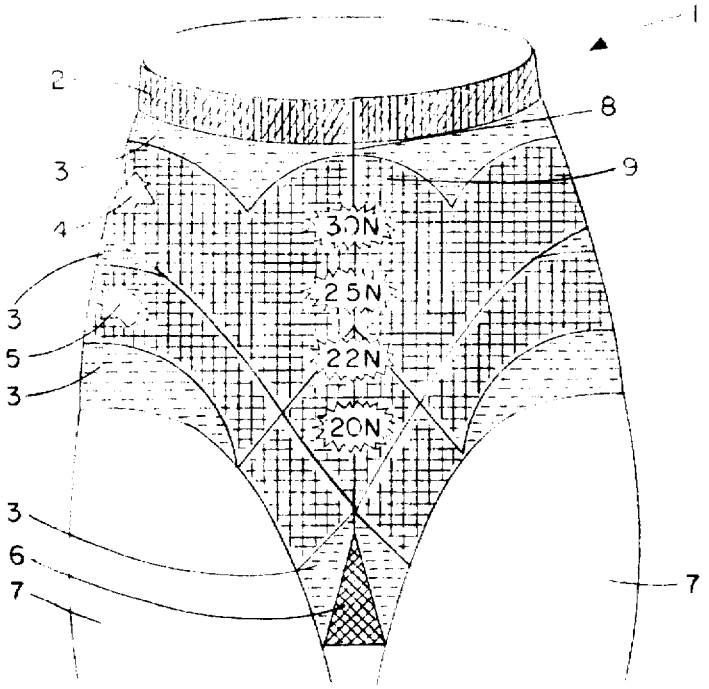
FIGS. 1 and 2 are respectively front and back views of tights in accordance with the invention.

a) a waistband 2;

b) a brief area 3, in which are formed first stripes 4 at the top crossing over at the front, widening to form a ventral panel 9 and substantially parallel to the belt 2 at the back, second stripes 5 at the bottom running, on the front, substantially from the crossing over of the stripes 4 to extend substantially parallel to top stripes 4 and to join them towards the middle of the back, c) a separately attached gusset 6; and d) legs 7.

The briefs may be made by a known technique using vertical seams 8 between slit knit tubular cylinders, but the invention also applies to items made without sewing.

Figure 3:
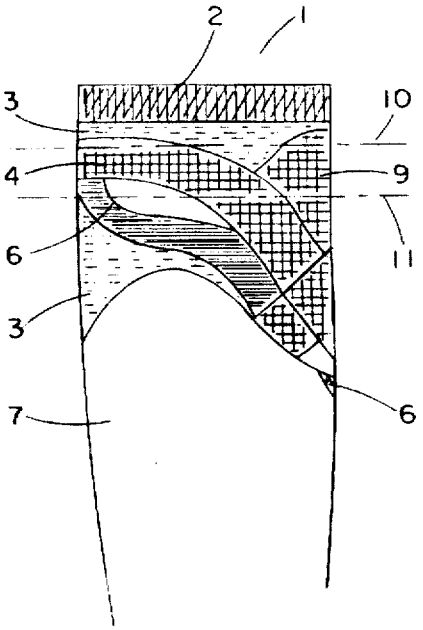
FIG. 3 shows a slit tubular item opened out flat, before sewing it to make the tights from FIGS. 1 and 2.

In accordance with the invention, the tubular item 1, or the half 1' shown in FIG. 3, is knitted in one piece and the modular elasticity of the various regions shown is obtained by varying not only the nature of the stitches but also their height, as required, in the same course.

DESCRIPTION OF THE PREFERRED EMBODIMENTS

Thus in the course at line 10 in FIG. 3, the height of the stitches is modified to correspond to the required elasticity for the area 4, the area 3 and the area 9. The same is true for the row corresponding to line 11, which encounters the areas 3, 5, 4 and 9.

The item can be knitted on, for example, a L404R knitting machine manufactured by LONATI (Italy). This is a single-cylinder drumless machine with four feeds for the manufacture of stockings and tights enabling the height of the stitches to be varied on each of the needles served by the four feeds.

Figure 2:
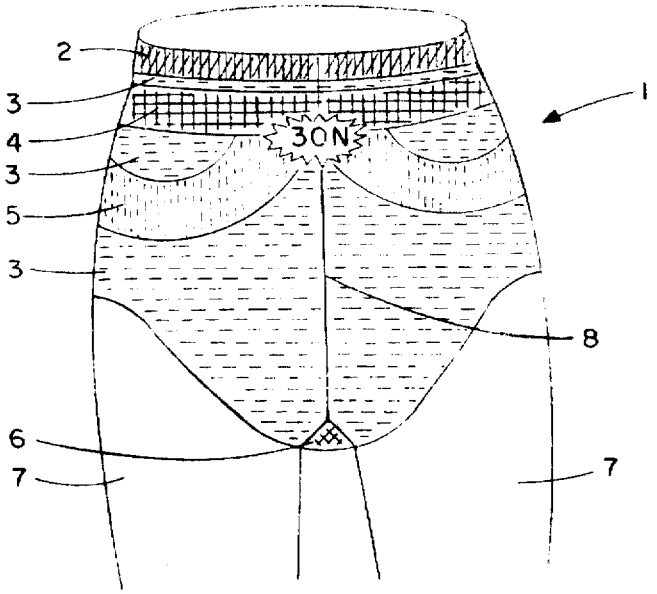

The construction of the panty portion after the two tubular cylinders are sewn together includes a finished welt 2, a 2×2 alternating tuck and jersey stitch section 3, downwardly curved stripes 4 formed by tightly knit jersey stitches, followed by lower stripes 5 also formed of 2×2 alternating tuck and jersey stitches. An upwardly rounded portion communicating with the upper stripes 4 is also formed of small jersey knit stitches. Upper and lower stripes 4,5 and the upper curved portion 9 are all set off by a line of tuck stitches 10 that form a defined border. Thus, when the front of the brief is viewed, top stripes 4 overlap bottom stripes 5 and the intersection of the upper and lower stripes 4,5 in the middle of the garment reflects a diamond shaped portion as a result of the tuck stitch border. Additional design contrast is achieved in the crotch 12 by having a gusset formed of one stitch configuration such as small jersey knit stitches and a surrounding area 14 again formed by a 2×2 alternating tuck and jersey configuration. The top stripe 4 extends along the rear portion of the panty substantially parallel and below the welt 2 as shown in FIG. 2. Lower stripes 5 extend around to the back portion of the panty and upwardly to tie into upper stripes 4. The stitch configuration on the rear part of the panty is consistent with the stitch configuration on the front of the panty in that stripes are formed from small tightly knit jersey stitches and the balance of the panty is formed with a 2×2 alternating tuck and jersey stitch configuration.

The use of tightly knit jersey stitches in the simulated stripes on the front portion of the panty form a tighter, less elastic garment portion to provide support in the lower front portion of the garment. The 2×2 alternating tuck and jersey stitches in the rear portion provide a looser knit and therefore a more stretchable fabric to accommodate the larger portion of the anatomy located in that area.

In one particular embodiment, the areas of the briefs 3, the strips 4 and 5 and the legs 7 are knitted with different stitches and with some tightening in some courses of stitches, to obtain in the lower part of the briefs 3 an open texture for holding without compressing (large stitches), in the ventral panel 9 and the high compression strips 4, small stitches for supporting the lower abdomen and the waist and for supporting the loins at the back, and in the medium compression strips 5 open stitches reinforcing the action of the ventral panel supporting the hips and contributing to the support of the loins. This particular embodiment produces the compression forces shown in FIGS. 1 and 2 on the lower abdomen and on the back; and it can be seen that the maximum compression is obtained in the lower abdomen area.

Figure 4:
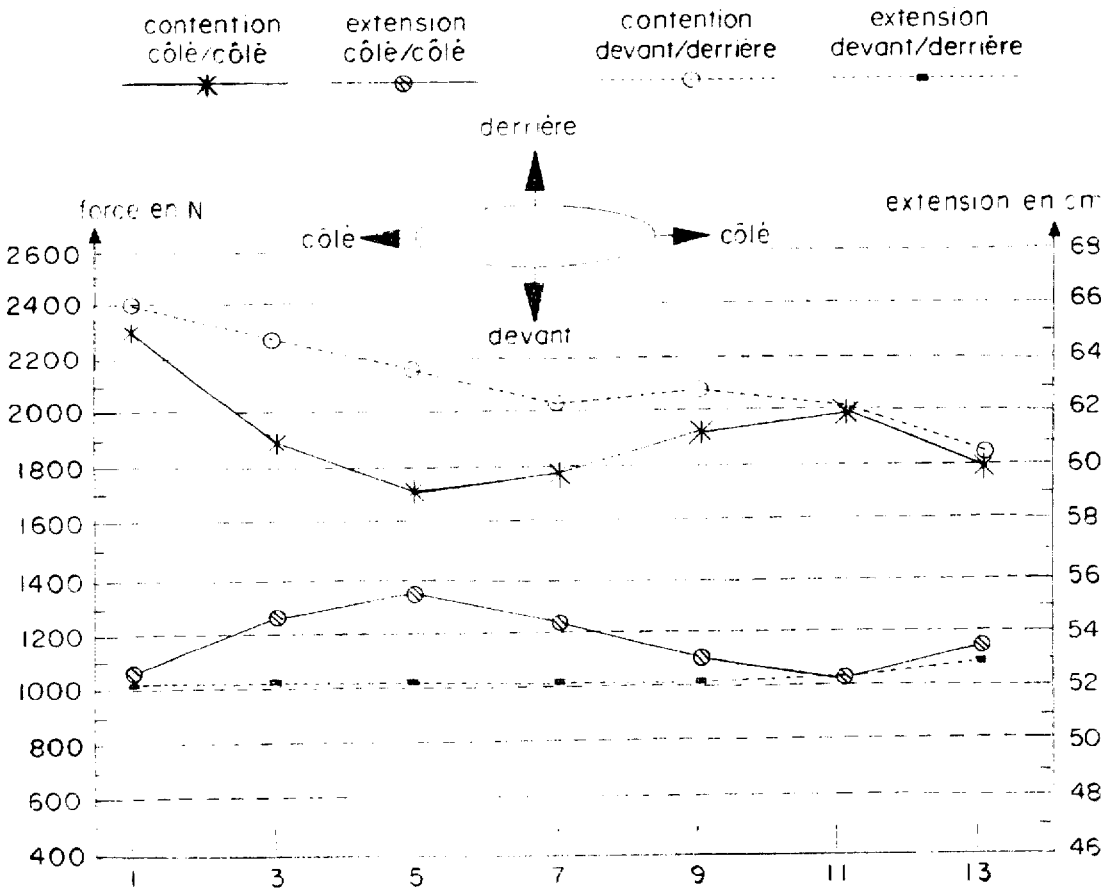
FIGS. 4 and 5 are graphs showing the restraining effect and the stretchability of two comparable items respectively made in accordance with and not in accordance with the invention.
Figure 5:
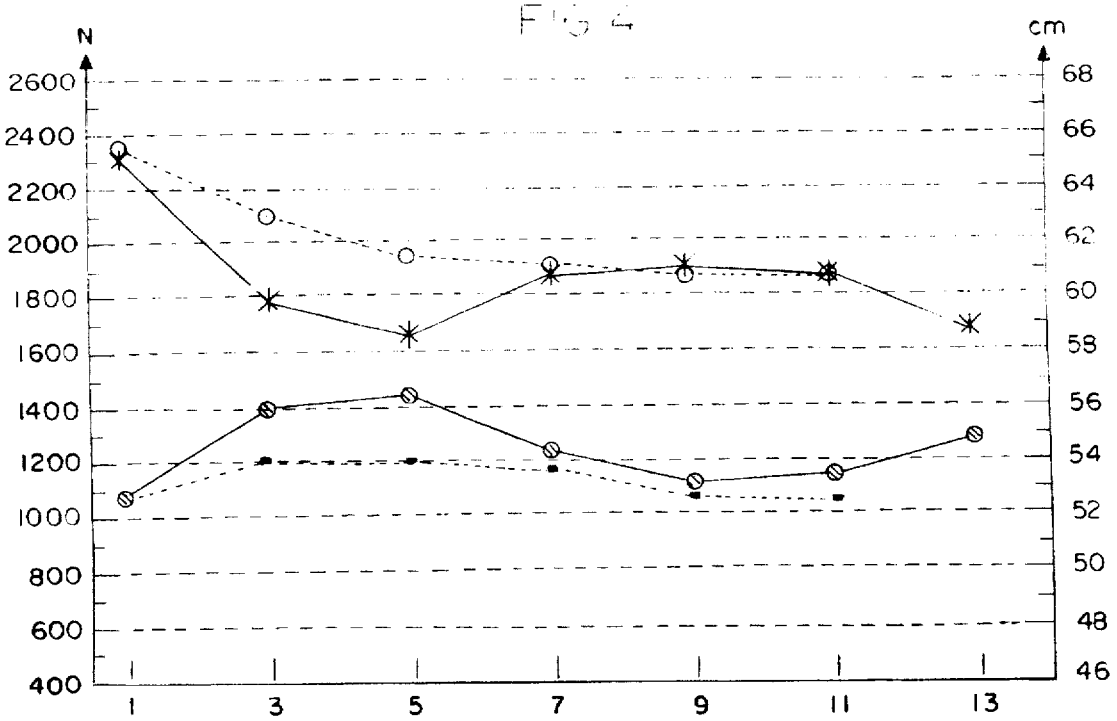

The graphs in FIGS. 4 and 5 show the results of measurement of the restraining effect (expressed in N) and stretchability (expressed in cm) for the brief of the tights made in accordance with the invention and for a brief with the same zoned stitches but where the stitch height is not reduced in some parts of the rows. The restraining effect and stretchability were measured from side to side and from front to back, as indicated by the key at the top of the graphs. The measurements were taken every 2 cm in horizontal planes from the waistband to the thigh.

Comparison of the FIG. 4 and FIG. 5 graphs shows that the solid line curves, corresponding to the side to side measurements, are somewhat similar, whereas the dashed line curves, corresponding to the front to back measurements, show a very clear improvement in the lower abdomen area due to the invention: increased restraining effect and reduced stretchability.

In the drawings and specification, there has been set forth a preferred embodiment of the invention, and although specific terms are employed, they are used in a generic and descriptive sense only and not for purposes of limitation.

KEY TO FIG. 4

English
side/side restraint
side/side stretch
front/back restraint
front/back stretch
force in N
stretch in cm
back
side
front

I claim:

1. A method of circularly and integrally knitting tubular items on a hosiery knitting machine to form tights having compressive supporting areas for the lower abdomen, waist and back of a wearer comprising the steps of: knitting a plurality of courses of stitches having selectable stitch heights in the brief of the tubular item; forming first and second stripes by varying the stitch heights at selected stripe locations; extending the formed stripes to form curved stripes with the stitch heights in the stripes being shorter than the stitch heights outside the stripes to produce compressive forces in the area of the stripes extending over the abdomen, waist and back.

2. A hosiery item formed from a pair of circularly and integrally tubular knit cylinders comprising: an upper portion forming a brief area and having support features incorporated therein; a plurality of courses in the brief area having compression stripes with curved angular ranges, the stripes having stitches with stitch heights in the lengthwise direction of the tube smaller than the stitch heights in the same course outside the stripes.

3. A hosiery item as claimed in claim 2 wherein at least one high compression strip in the brief extends through angular ranges having first and second ends, the first ends of which crossover at the front to form a ventral panel.

4. A hosiery item as claimed in claim 3 wherein a medium compression stripe is provided under the first stripe.

5. A hosiery item as claimed in claim 4 wherein the medium compression second stripe has first and second ends, the first ends of which crossover with the crossover first ends of the high compression stripe to form a ventral panel.

* * * * *